US009475662B2

(12) United States Patent
Tanaka et al.

(10) Patent No.: US 9,475,662 B2
(45) Date of Patent: Oct. 25, 2016

(54) SHEET FEEDING CASSETTE, AND IMAGE FORMING APPARATUS HAVING THE SAME

(71) Applicant: KYOCERA Document Solutions Inc., Osaka (JP)

(72) Inventors: Hiroyuki Tanaka, Osaka (JP); Motoyuki Fukuda, Osaka (JP); Tetsuya Ichiguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/937,274

(22) Filed: Nov. 10, 2015

(65) Prior Publication Data

US 2016/0167900 A1 Jun. 16, 2016

(30) Foreign Application Priority Data

Dec. 10, 2014 (JP) ..... 2014-249598

(51) Int. Cl.
*B65H 1/00* (2006.01)
*B65H 1/26* (2006.01)
*B65H 1/04* (2006.01)

(52) U.S. Cl.
CPC ..... *B65H 1/266* (2013.01); *B65H 1/00* (2013.01); *B65H 1/04* (2013.01); *B65H 2402/412* (2013.01); *B65H 2405/11* (2013.01); *B65H 2405/113* (2013.01); *B65H 2405/31* (2013.01); *B65H 2511/152* (2013.01)

(58) Field of Classification Search
CPC ..... B65H 1/00; B65H 1/04; B65H 2405/11; B65H 2405/113; B65H 2405/31; B65H 2511/152; B65H 1/266; B65H 2402/412
USPC ..... 271/145, 162; 221/6, 2, 155
See application file for complete search history.

(56) References Cited

U.S. PATENT DOCUMENTS 3,174,608 A * 3/1965 Knickerbocker ..... G07F 5/04 194/247
5,042,687 A * 8/1991 McKinley ..... A47F 13/085 221/155
5,390,821 A * 2/1995 Markel ..... A47F 1/08 206/427
5,836,478 A * 11/1998 Weiss ..... B65D 5/725 221/155
6,021,919 A * 2/2000 Kelly ..... A61B 19/045 221/155
6,062,424 A * 5/2000 Simile-Gravina ..... A47F 1/08 206/746
6,840,511 B1 * 1/2005 Hung ..... B65H 1/00 271/145
2009/0166954 A1 * 7/2009 Shiohara ..... B65H 1/266 271/109
2014/0319759 A1 * 10/2014 Fujii ..... B65H 1/266 271/162
2014/0367401 A1 * 12/2014 Stralin ..... A47K 10/22 221/6

FOREIGN PATENT DOCUMENTS

JP H 9-2672 A 1/1997
JP H 11-11743 A 1/1999

* cited by examiner

*Primary Examiner* — David H Bollinger
(74) *Attorney, Agent, or Firm* — Stein IP, LLC

(57) ABSTRACT

A sheet feeding cassette according to the present disclosure includes a storing region and a front surface portion. The storing region stores a sheet. The front surface portion is disposed on a downstream side of the storing region in a drawing direction and composes a portion of an outer surface of an image forming apparatus. The one side portion and other side portion of the front surface portion in a left-right direction are respectively provided with a first opening portion and a second opening portion where the storing region can be visually checked.

8 Claims, 5 Drawing Sheets

SHEET FEEDING CASSETTE, AND IMAGE FORMING APPARATUS HAVING THE SAME

INCORPORATION BY REFERENCE

The present application is based on Japanese Patent Application No. 2014-249598 filed on Dec. 10, 2014, the contents of which are hereby incorporated by reference.

BACKGROUND

The present disclosure relates to a sheet feeding cassette that is used in image forming apparatuses such as a digital copy machine, a laser printer and the like and stores sheets, and to an image forming apparatus that includes the sheet feeding cassette.

Conventionally, sheet feeding cassettes are widely used which stack and store a plurality of sheet-like papers and supply the sheets to an image forming portion of an image forming apparatus main body in accordance with an image forming operation.

For example, an image forming apparatus is known which has a structure in which a front surface portion of the sheet feeding cassette is provided with a window, the apparatus main body is provided with a two-color LED, wherein the two-color LED can be confirmed from the window of the sheet feeding cassette with the sheet feeding cassette mounted in the apparatus main body. In this image forming apparatus, the two-color LED emits yellow light when the sheets are running out and emits red light when there are no sheets. Accordingly, even in a state in which the sheet feeding cassette is mounted in the apparatus main body, it is possible to confirm presence of the sheets by visually checking the two-color LED.

Besides, an image forming apparatus is known in which a front surface portion of a sheet feeding tray (sheet feeding cassette) is provided with a peep window, whereby even in a state in which the sheet feeding tray is mounted in the apparatus main body, it is possible to confirm presence of sheets.

SUMMARY

A sheet feeding cassette according to an aspect of the present disclosure is a sheet feeding cassette that is insertable and drawable into and from an apparatus main body, and includes a storing region and a front surface portion. The storing region stores sheets. The front surface portion is disposed on a downstream side of the storing region in a drawing direction and composes a portion of an outer surface of an image forming apparatus. The one side portion and other side portion of the front surface portion in a left-right direction are respectively provided with a first opening portion and a second opening portion where the storing region can be visually checked.

Still other objects of the present disclosure and specific advantages obtained from the present disclosure will become more apparent from the following detailed description of preferred embodiments describe later.

DETAILED DESCRIPTION

Hereinafter, embodiments of the present disclosure are described with reference to the drawings.

First Embodiment

Figure 1:
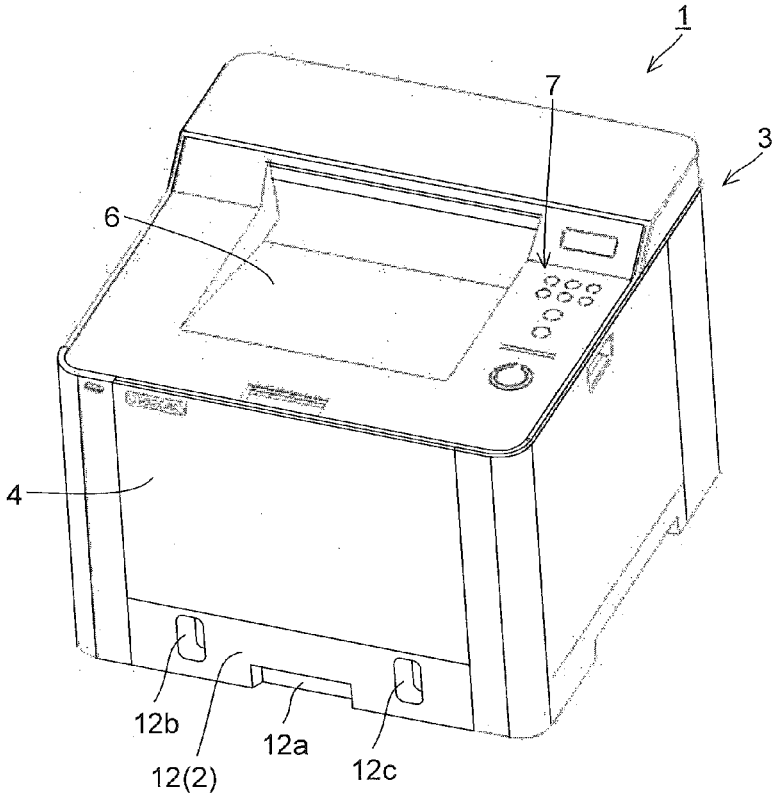
FIG. 1 a perspective view showing a structure of an image forming apparatus that includes a sheet feeding cassette according to a first embodiment of the present disclosure.

With reference to FIG. 1 to FIG. 4, an image forming apparatus 1, which includes a sheet feeding cassette 2 according to a first embodiment of the present disclosure, is described. As shown in FIG. 1, the image forming apparatus 1 includes an apparatus main body 3 that has a substantially hexahedral structure. A front surface portion of the apparatus main body 3 which a user faces is provided with a front cover 4, which is disposed on the apparatus main body 3 in an openable and closable manner and opened to serve as a manual feeding tray, and a sheet feeding cassette 2 that is mountable and demountable in and from the apparatus main body 3. An upper portion of the apparatus main body 3 is provided with a delivery tray 6 onto which a sheet is delivered, and an operation portion 7 that includes a plurality of buttons and the like.

The apparatus main body 3 is provided therein with an image forming portion, a fixing portion, a sheet conveyance path and the like that are not shown. The imager forming portion transfers a toner image to a supplied sheet to form an image based on image data acquired from terminals such as a personal computer and the like. The image forming portion includes: a photosensitive drum (image carrying body) that carries an electrostatic latent image; an electrifying unit that electrifies a surface of the photosensitive drum; a light exposure unit that forms an electrostatic latent image on the surface of the photosensitive drum corresponding to a document image by means of a laser beam and the like; a developing device that forms a toner image by making a developer adhere to the formed electrostatic latent image; a transfer roller that transfers the toner image to a sheet; a cleaning blade that removes a remaining toner on the photosensitive drum surface and the like. Besides, the fixing portion fixes the toner image on the sheet by heating and pressing the sheet on which the tone image is transferred.

Next, a structure of the sheet feeding cassette 2 is described. A not-shown rail portion, which is disposed on a side surface of a cassette main body 10, is engaged with a not-shown rail in the image forming apparatus 1, whereby the sheet feeding cassette 2 is slid in an arrow AA' direction shown in FIG. 2 to be mounted and demounted.

Figure 2:
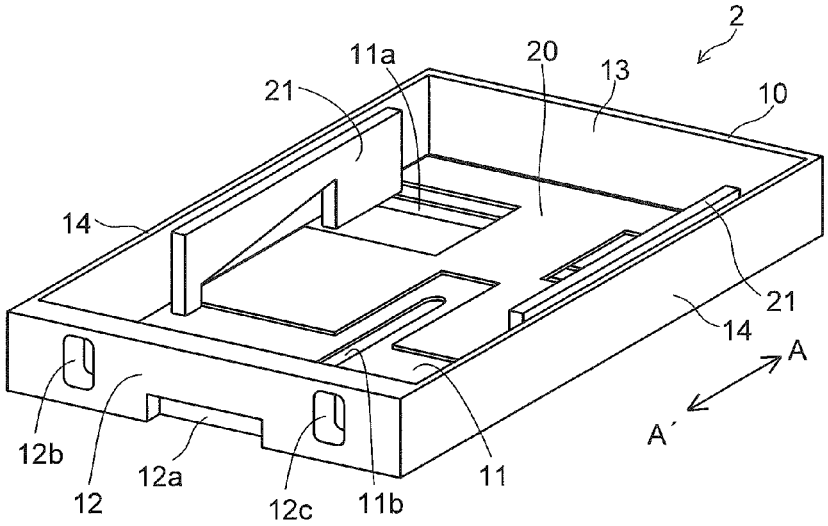
FIG. 2 is a perspective view showing a structure of the sheet feeding cassette according to the first embodiment of the present disclosure.

As shown in FIG. 2, the cassette main body 10 is composed into a flat box shape with an upper surface opened, loads and stores sheets from an upper surface direction. Besides, the cassette main body 10 includes: a bottom surface portion 11 onto which the sheets are loaded, a front surface portion 12, a rear surface portion 13, and a pair of side surface portions 14 that are formed upright on four circumferential edges of the bottom surface portion 11, and is integrally formed of resin.

In the image forming apparatus 1, a sheet feeding device (not shown) is disposed above the rear surface portion 13 situated on a downstream side of the cassette main body 10 in the insertion direction, and the sheet is supplied in an arrow A direction (direction of mounting the sheet feeding cassette 2 into the apparatus main body 3) shown in FIG. 2. The front surface portion 12 is disposed on an arrow A' direction side (downstream side in the drawing direction), and exposed to outside to compose a portion of an outer surface of the image forming apparatus 1. A handle portion 12*a* is formed on a lower portion of a center portion of the front surface portion 12 in a left-right direction. The handle portion 12*a* is formed not to penetrate the front surface portion 12.

Figure 3:
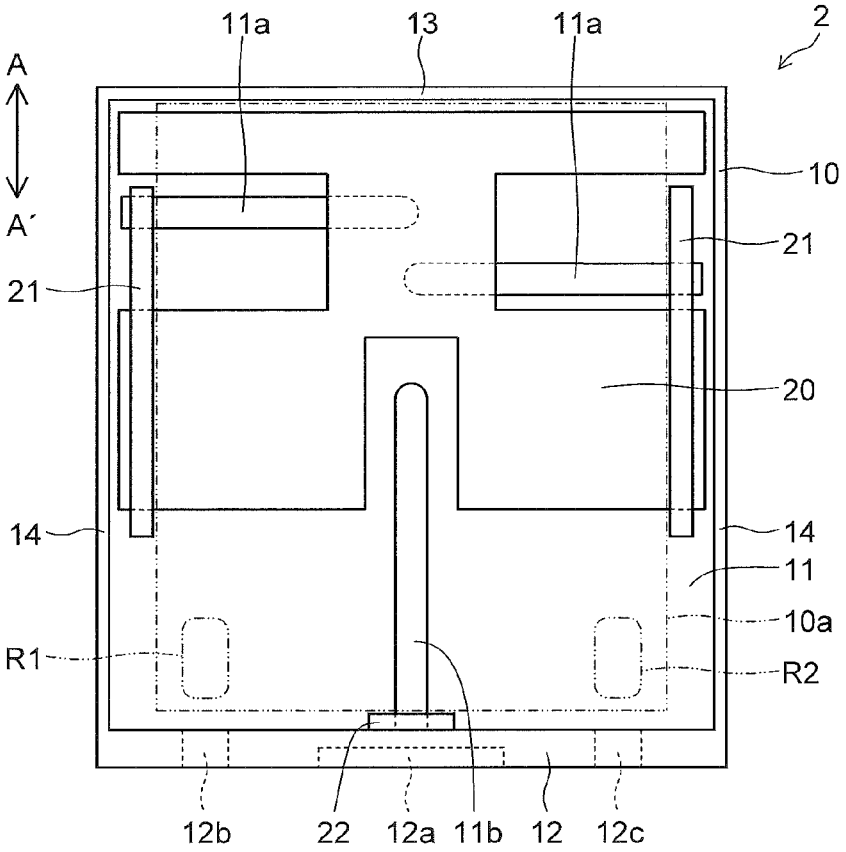
FIG. 3 is a plan view showing the structure of the sheet feeding cassette according to the first embodiment of the present disclosure.

As shown in FIG. 2 and FIG. 3, the bottom surface portion 11 of the cassette main body 10 is provided thereon with a sheet loading plate 20 on which a sheet is loaded. A bias member (not shown) such as a compression coil spring or the like is disposed under the sheet loading plate 20, and the sheet loading plate 20 pivots on an end portion in the arrow A' direction as a fulcrum, whereby a portion on a downstream side (arrow A direction side) in the sheet feeding direction is stepped up/down vertically. The sheet loading plate 20 rises to a predetermined position, whereby the uppermost sheet is fed by the sheet feeding device and conveyed to the image forming portion.

The cassette main body 10 is provided therein with a pair of width limiting cursors 21 formed of resin that are formed upright along the sheet feeding direction (arrow A direction). The width limiting cursors 21 butt side surfaces of a sheet bundle from both sides in a sheet width direction perpendicular to the sheet feeding direction and thereby position the sheets in the width direction. The width limiting cursors 21 are movable along a width limiting cursor movement groove 11*a* that is disposed on the bottom surface portion 11 of the cassette main body 10 and extends in the sheet width direction.

Lower portions of the width limiting cursors 21 are each provided thereon with a groove engaging portion (not shown), and the groove engaging portion engages with the width limiting cursor movement groove 11*a* formed on the bottom surface portion 11 of the cassette main body 10, whereby the width limiting cursors 21 are prevented from coming off the cassette main body 10. In the meantime, if one of the pair of width limiting cursors 21, which butt the side surfaces of the sheet bundle from both sides in the sheet width direction, is moved by a not-shown associating mechanism disposed under the width limiting cursors 21, the other one also moves associating with the one. At this time, the pair of width limiting cursors 21 move in a left-right symmetric manner with respect to a center line in the sheet width direction.

A rear end limiting cursor 22 formed of resin is provided on an upstream side in the sheet feeding direction in the cassette main body 10. The rear end limiting cursor 22 butts a side surface of the sheet bundle from an upstream side in the sheet feeding direction to position the sheets in the sheet feeding direction. The rear end limiting cursor 22 is movable along a rear end limiting cursor movement groove 11*b* that is disposed on the bottom surface portion 11 of the cassette main body 10 and extends in the sheet feeding direction. Like the width limiting cursor 21, a not-shown groove engaging portion disposed on a lower portion engages with the rear end limiting cursor movement groove 11*b*, whereby the rear end limiting cursor 22 is prevented from coming off the cassette main body 10.

Figure 4:
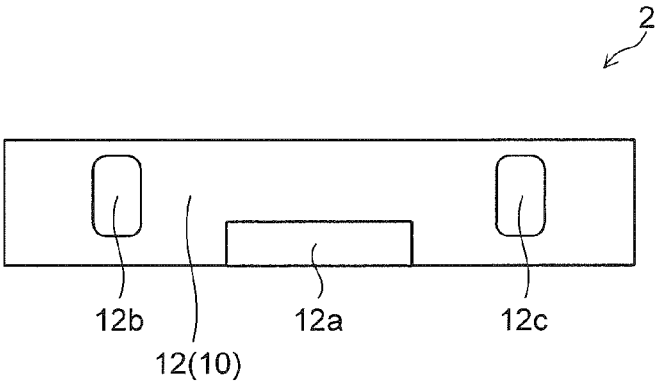
FIG. 4 is a front view showing a structure of a front surface portion of the sheet feeding cassette according to the first embodiment of the present disclosure.

Here, as shown in FIG. 4, the one side (left) portion and other side (right) portion of the front surface portion 12 of the cassette main body 10 are respectively provided with a first opening portion 12*b* and a second opening portion 12*c* that are vertically long. The first opening portion 12*b* and the second opening portion 12*c* are disposed at positions where the user can visually check a storing region 10*a* (see FIG. 3) in the cassette main body 10, in which the sheets are stored, via the first opening portion 12*b* and the second opening portion 12*c*. In the present embodiment, regions visually checked from the first opening portion 12*b* and the second opening portion 12*c* include a region centering on and around a region R1 shown in FIG. 3 and a region centering on and around a region R2 shown in FIG. 3, but do not include a region other than the storing region 10*a*. In the meantime, the regions visually checked from the first opening portion 12*b* and the second opening portion 12*c* are regions that are seen via the first opening portion 12*b* and the second opening portion 12*c* respectively when seeing slightly above the sheet feeding cassette 2 from the front side.

In the present embodiment, as described above, the one side (left) portion and other side (right) portion of the front surface portion 12 are respectively provided with the first opening portion 12*b* and the second opening portion 12*c* where the storing region 10*a* can be visually checked. Because of this, for example, the region R1 visually checked from the first opening portion 12*b* becomes bright because light entering from the second opening portion 12*c* joins. Accordingly, the user can surely check for presence of the sheets via the first opening portion 12*b*.

Besides, likewise, the region R2 visually checked from the second opening portion 12*c* becomes bright because light entering from the first opening portion 12*b* joins. Accordingly, the user can surely check for presence of the sheets via the second opening portion 12*c*. Because of this, the user can confirm presence of the sheets from both left and right directions of the front surface portion 12.

Besides, unlike the conventional image forming apparatus, the two-color LED and the control portion are not required. Accordingly, it is possible to surely confirm presence of the sheets by mean of a simple structure. Besides, even during a power-off time of the image forming apparatus 1, it is possible to confirm presence of the sheets.

Second Embodiment

Figure 5:
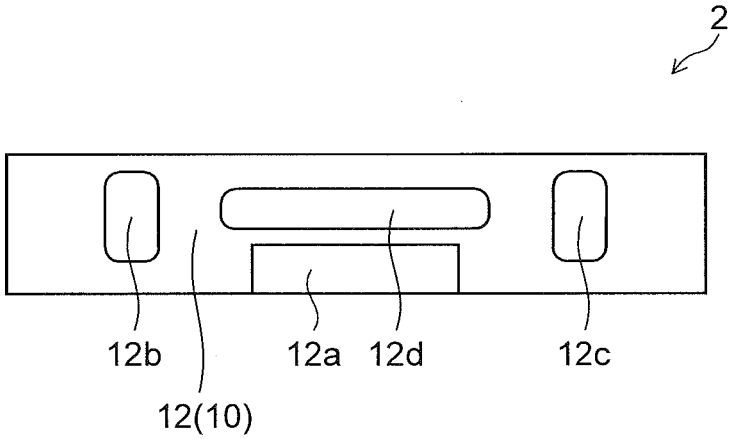
FIG. 5 is a front view showing a structure of a front surface portion of a sheet feeding cassette according to a second embodiment of the present disclosure.

Next, with reference to FIG. 5, the sheet feeding cassette 2 according to a second embodiment of the present disclosure is described. In the second embodiment of the present disclosure, as shown in FIG. 5, a center portion (between the first opening portion 12*b* and the second opening portion 12*c*) of the front surface portion 21 of the cassette main body 10 in a left-right direction is provided with a third opening portion 12*d* that extends in the left-right direction and is elongate. Like the first opening portion 12*b* and the second opening portion 12*c*, the third opening portion 12*d* is formed of a through-hole in such a manner that it is possible to introduce light to the storing region 10*a*. Besides, the third opening portion 12*d* is formed at a position close to an upper side. Accordingly, it is easy to introduce light.

The other structures of the second embodiment are the same as the first embodiment.

In the present embodiment, as described above, the center portion of the front surface portion 12 in the left-right direction is provided with the third opening portion 12*d* that extends in the left-right direction. Because of this, light enters from the third opening portion 12*d* as well. Accordingly, it is possible to make the inside of the sheet feeding cassette 2 brighter. Because of this, the user can confirm presence of the sheets more surely.

The other effects of the second embodiment are the same as the first embodiment.

Third Embodiment

Figure 6:
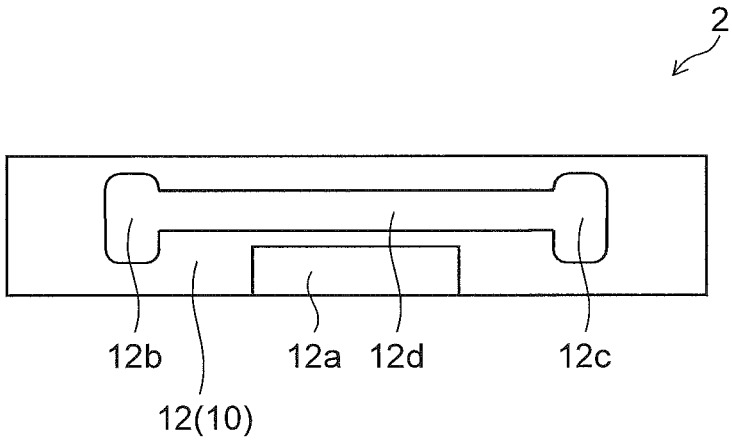
FIG. 6 is a front view showing a structure of a front surface portion of a sheet feeding cassette according to a third embodiment of the present disclosure.

Next, with reference to FIG. 6, the sheet feeding cassette 2 according to a third embodiment of the present disclosure is described. In the third embodiment of the present disclosure, as shown in FIG. 6, one end (left end portion) of the third opening portion 12*d* of the front surface portion 12 connects to the first opening portion 12*b*, and the other end (right end portion) of the third opening portion 12*d* connects to the second opening portion 12*c*.

The other structures of the third embodiment are the same as the second embodiment.

In the present embodiment, as described above, the one end (left end portion) of the third opening portion 12*d* connects to the first opening portion 12*b*, and the other end (right end portion) of the third opening portion 12*d* connects to the second opening portion 12*c*. Because of this, it is possible to introduce more light into the sheet feeding cassette 2.

The other effects of the third embodiment are the same as the second embodiment.

Fourth Embodiment

Figure 7:
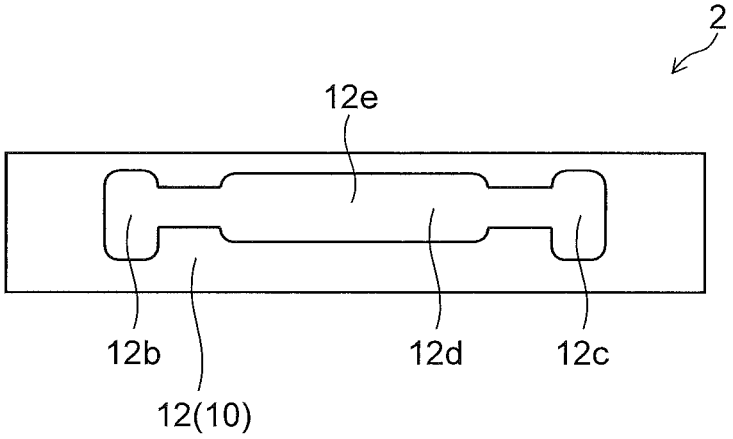
FIG. 7 is a front view showing a structure of a front surface portion of a sheet feeding cassette according to a fourth embodiment of the present disclosure.

Next, with reference to FIG. 7, the sheet feeding cassette 2 according to a fourth embodiment of the present disclosure is described. In the fourth embodiment of the present disclosure, as shown in FIG. 7, the center portion of the third opening portion 12*d* in the left-right direction is provided with a wide portion 12*e* whose opening width in a vertical direction is wide compared with other portions. The wide portion 12*e* doubles as a handle when the user draws out the sheet feeding cassette 2 from the apparatus main body 3. Because of this, in the present embodiment, the front surface portion 12 is not provided with the handle portion 12*a*.

The other structures of the fourth embodiment are the same as the third embodiment.

In the present embodiment, as described above, the third opening portion 12*d* doubles as a handle when the user draws out the sheet feeding cassette 2 from the apparatus main body 3. Because of this, it is not necessary to dispose the handle portion 12*a* separately. Accordingly, it is possible to simplify the structure of the cassette main body 10.

Besides, as described above, the third opening portion 12*d* is provided with the wide portion 12*e* whose opening width in the vertical direction is wide compared with the other portions, and the wide portion 12*e* functions as the handle. Because of this, it is easy to grasp the handle (wide portion 12*e*).

The other effects of the fourth embodiment are the same as the third embodiment.

It should be considered that the embodiments disclosed this time are examples in all respects and are not limiting. The scope of the present disclosure is not indicated by the above description of the embodiments but by the claims, and all modifications within the scope of the claims and the meaning equivalent to the claims are covered.

For example, in the above embodiments, the image forming apparatus using an electro-photographic system is described as an example, but this is not limiting, and the present disclosure is applicable to image forming apparatuses that use other image forming systems such as an ink-jet system, a thermal transfer system and the like, further, also applicable widely to apparatuses that only convey sheets, apparatuses and the like that post-process sheets and the like on which an image is formed.

Besides, in the above embodiments, the example is described, in which the region R1 visually checked from the first opening portion 12*b* does not include the region other than the storing region 10*a*, but the region R1 visually checked from the first opening portion 12*b* may include the storing region 10*a* and the other regions (regions around the storing region 10*a*). This applies also to the region R2 visually checked from the second opening portion 12*c*.

Figure 8:
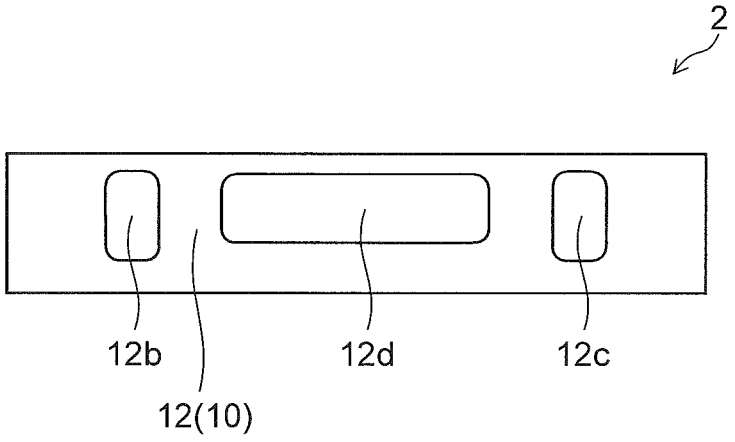
FIG. 8 is a front view showing a structure of a front surface portion of a sheet feeding cassette according to a first modification of the present disclosure.

Besides, for example, in the fourth embodiment, the example is described, in which the third opening portion 12*d*, which connects to the first opening portion 12*b* and the second opening portion 12*c*, is provided with the wide portion 12*e* whose width in the vertical direction is wider than the other portions, and the wide portion 12*e* is made to function as the handle. However, the present disclosure is not limited to this. For example, as in the sheet feeding cassette 2 shown in FIG. 8 according to a first modification of the present disclosure, the third opening portion 12*d*, which does not connect to the first opening portion 12*b* and the second opening portion 12*c*, may be formed to become wide in the vertical direction and may be made to function as a handle.

Figure 9:
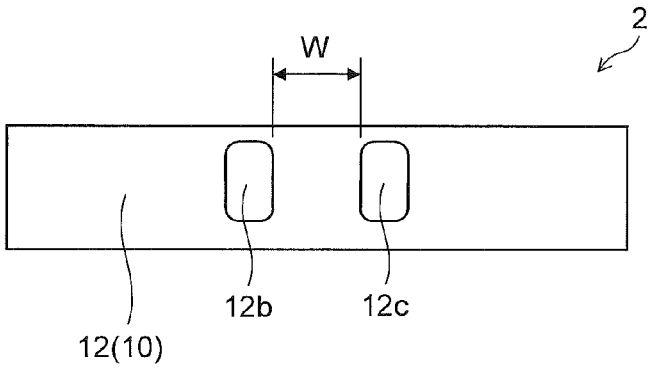
FIG. 9 is a front view showing a structure of a front surface portion of a sheet feeding cassette according to a second modification of the present disclosure.

Besides, as in the sheet feeding cassette 2 shown in FIG. 9 according to a second modification of the present disclosure, the first opening portion 12*b* and the second opening portion 12*c* may compose one handle. Specifically, the first opening portion 12*b* and the second opening portion 12*c* are disposed at portions close to the center of the front surface portion 12 in the left-right direction. For example, a distance (W) between the first opening portion 12*b* and the second opening portion 12*c* is set at about 5 cm to 12 cm. According to this structure, the first opening portion 12*b* and the second opening portion 12*c* compose one handle that can be grasped by a thumb and an index finger. In this case, it is not necessary to dispose the handle portion 12*a*. Accordingly, it is possible to simplify the structure of the cassette main body 10.

Figure 10:
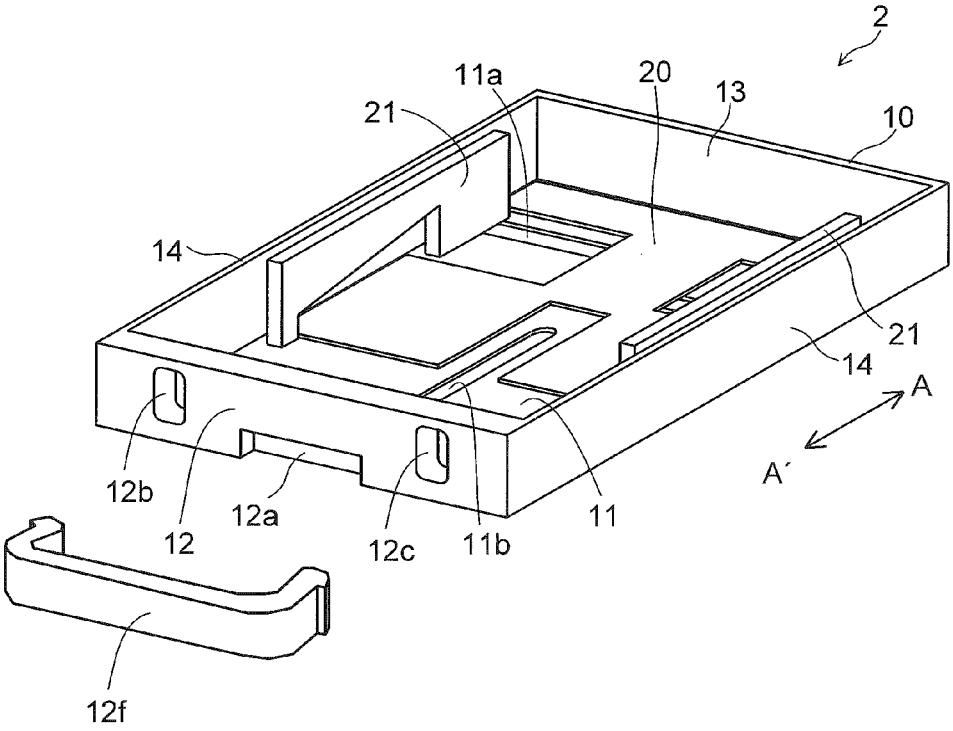
FIG. 10 is a perspective view showing a structure of a sheet feeding cassette according to a third modification of the present disclosure.

In the meantime, if the image forming apparatus 1 is used in an environment where there is much dust, there is a case where dust invades from the first opening portion 12*b*, the second opening portion 12*c* and the like to dirty the inside of the sheet feeding cassette 2. Because of this, a user, who seeks to improve dust-proofness of the sheet feeding cassette 2 rather than confirmation of the number of remaining sheets, does not need the first opening portion 12*b* and the second opening portion 12*c*. In this case, as in the sheet feeding cassette 2 shown in FIG. 10 according to a third modification of the present disclosure, a U-shaped handle member 12*f*, which engages with the first opening portion 12*b* and the second opening portion 12*c*, may be mounted. In other words, the first opening portion 12*b* and the second opening portion 12*c* may be made to function as mounting holes for the U-shaped handle member 12*f*.

Besides, also structures obtained by suitably combining the structures of the above embodiments and modifications are covered by the technical scope of the present disclosure.

What is claimed is:

1. A sheet feeding cassette that is insertable and drawable into and from an apparatus main body, comprising:

a storing region that stores a sheet, and a front surface portion that is disposed on a downstream side of the storing region in a drawing direction and comprises a portion of an outer surface of an image forming apparatus, wherein the sheet inside the sheet feeding cassette is conveyed in a sheet feeding direction opposite to the drawing direction, a sheet loading plate on which the sheet is loaded is provided on a bottom surface of the sheet feeding cassette, the sheet loading plate pivoting on, as a fulcrum, an end portion thereof on an upstream side in the sheet feeding direction such that a portion of the sheet loading plate on a downstream side in the sheet feeding direction is stepped up/down vertically, an end limiting cursor is provided inside the sheet feeding cassette, the end limiting cursor being movable along the sheet feeding direction, the end limiting cursor abutting an edge of the sheet from an upstream side in the sheet feeding direction, one side portion and another side portion of the front surface portion located across the end limiting cursor in a left-right direction are respectively provided with a first opening portion and a second opening portion where an edge portion of the sheet in the storing region is able to be visually checked.

2. The sheet feeding cassette according to claim 1, wherein a third opening portion, which extends in the left-right direction, is formed between the first opening portion and second opening portion of the front surface portion.

3. The sheet feeding cassette according to claim 2, wherein one end of the third opening portion connects to the first opening portion, and another end of the third opening portion connects to the second opening portion.

4. The sheet feeding cassette according to claim 2, wherein the third opening portion doubles as a handle when the sheet feeding cassette is drawn from the apparatus main body.

5. The sheet feeding cassette according to claim 4, wherein the third opening portion is provided with a wide portion whose opening width in a vertical direction is wide compared with another portion, and the wide portion functions as the handle.

6. An image forming apparatus that comprises the sheet feeding cassette according to claim 1.

7. A sheet feeding cassette that is insertable and drawable into and from an apparatus main body, comprising:

a storing region that stores a sheet, and a front surface portion that is disposed on a downstream side of the storing region in a drawing direction and comprises a portion of an outer surface of an image forming apparatus, wherein one side portion and another side portion of the front surface portion in a left-right direction are respectively provided with a first opening portion and a second opening portion where the storing region is able to be visually checked, the first opening portion and the second opening portion are disposed at portions close to a center of the front surface portion in the left-right direction, and the first opening portion and the second opening portion comprise a handle when the sheet feeding cassette is drawn from the apparatus main body.

8. A sheet feeding cassette that is insertable and drawable into and from an apparatus main body, comprising:

a storing region that stores a sheet, a front surface portion that is disposed on a downstream side of the storing region in a drawing direction and comprises a portion of an outer surface of an image forming apparatus, and a U-shaped handle member, wherein one side portion and another side portion of the front surface portion in a left-right direction are respectively provided with a first opening portion and a second opening portion where the storing region is able to be visually checked, and the U-shaped handle member engages with the first and second opening portions.

* * * * *